US005243818A

United States Patent [19]

Schatz

[11] Patent Number: 5,243,818

[45] Date of Patent: Sep. 14, 1993

[54] METHOD FOR THE OPERATION OF AN IC ENGINE WITH LOW EMISSIN OF POLLUTANTS AND AN ARRANGEMENT FOR PERFORMING THE METHOD

[76] Inventor: Oskar Schatz, Waldpromenade 16, D-8035 Gauting, Fed. Rep. of Germany

[21] Appl. No.: 535,472

[22] Filed: Jun. 8, 1990

[51] Int. Cl.[5] ..... F01N 3/26

[52] U.S. Cl. ..... 60/274; 60/298; 60/303; 422/173

[58] Field of Search ..... 60/274, 298, 303, 286; 422/173

[56] References Cited

U.S. PATENT DOCUMENTS

| | | | |
|---|---|---|---|
| 3,737,286 | 6/1973 | Kofink | 60/303 |
| 3,754,398 | 8/1973 | Mattavi | 60/298 |
| 3,874,854 | 4/1975 | Hunter | 60/298 |

*Primary Examiner*—Douglas Hart

*Attorney, Agent, or Firm*—Harness, Dickey & Pierce

[57] ABSTRACT

For the operation of an IC engine for low emission of pollutants and with the passage of the engine exhaust gases through a thermal converter (14), the conversion temperature is produced and maintained even in periods in which the engine temperature is otherwise too low by a heating device (14) supplied by the engine exhaust gases and designed in the form of a thermal converter.

2 Claims, 1 Drawing Sheet

METHOD FOR THE OPERATION OF AN IC ENGINE WITH LOW EMISSIN OF POLLUTANTS AND AN ARRANGEMENT FOR PERFORMING THE METHOD

BACKGROUND OF THE INVENTION

The invention relates to a method for the operation of an IC engine to achieve a low pollutant emission rate, in which the engine exhaust gases are led off through an thermal converter and to an arrangement for performing the method.

For the reduction of pollutant emission from automobile engines catalytic converters and more especially three-way catalytic converter have come into use as effective devices but which are somewhat high in price, largely because of the need to exactly regulate the ratio between the quantities of fuel and air.

Converters designed to cause catalytic oxidation are lower in price. They only reduce the emission of CO, unburned hydrocarbons and soot or particles.

In order to reduce the emission of pollutants from IC engines thermal converters have also been used, which perform their task without the use of catalytic materials owing to the maintenance of sufficiently high temperatures to oxidize CO, hydrocarbons and soot or particles in the exhaust gas.

Furthermore converters have been equipped with fuel burners in order to reach the conversion temperature during phases of engine operation which would otherwise not produce the necessary heating effect, but this also involves high costs.

The expense of such known equipment and fittings for reducing the emission of pollutants makes itself more especially felt when the purchase price of an automobile is low, that is to say particularly in the case of small, low horsepower cars.

During the course of design development IC engines with specially low pollutant emission rates have been evolved, which are able to be run near the statutory emission rates, but which in order to keep to such limits require a catalytic converter which leads to a high undesired increase in the purchase price of such a vehicle.

SHORT SUMMARY OF THE PRESENT INVENTION

One subject of the present invention is to make it possible for such engines to be operated more economically, that is to say with a low purchase price of the automobile in the first place and thus with low running costs and in particular without the necessity of expensive catalytic treatment of the exhaust gases.

A still further aim of the invention is to reduce the overall size of pollutant reducing equipment with a view to the incorporation thereof in small private cars.

In order to achieve these or other objects appearing from the present specification, claims and drawing, the method of operations is such that engine exhaust gases are led off through a thermal converter, which is improved in accordance with he invention since in operational states of the engine at excessively low temperatures the conversion temperature is reached and maintained by a heating device supplied by the engine exhaust gases and the conversion takes place in the heating device.

Thus both during starting from cold and also in phases of engine operation at a low speed and/or a low load, a source of low price thermal energy is available for increasing the exhaust gas temperature to the conversion temperature after the heat storage measn has been previously charged with the necessary amount of heat during operation of the engine with high exhaust gas temperatures. As a result it is possible to achieve a substantial reduction in the operating costs of small private cars with low pollutant emission rates. Since the conversion takes place in the heating device, the amount of space required for the arrangement needed for performing the method is small so that such an arrangement is also feasible for small private cars.

Furthermore conventional systems for the reduction of soot or particles from commercial vehicles are expensive, so that a reduction in costs may be expected if the system in accordance with the invention is utilized for them.

In accordance with a first embodiment of the method of the invention the engine exhaust gases are caused to pass through a heat storage means and the conversion takes place therein.

In accordance with another expedient form of the invention the engine exhaust gases are caused to pass through a heat exchanger which is swept by a heat vehicle fluid (supplied via a heat storage means in order to exchange heat with the engine exhaust gases), as long as the temperature of the exhaust gases is below a limit dependent on the thermal tolerance of the heat storage means and/or of the heat vehicle fluid, the conversion taking place in the heat exchanger.

In accordance with the invention an arrangement for performing the method is characterized in that a heating device is arranged in the exhaust gas path of an IC engine, which is designed in the form of a thermal converter and is supplied by the engine exhaust gases.

A convenient embodiment of this arrangement is such that the heating device is a heat storage means, the arrangement being designed as a type of heat storage means suitable for the maximum exhaust gas temperature to be expected during operation of the system.

For instance, in order to be able to rapidly attain the necessary temperatures even after relatively long interruptions in operation, it may be expedient to use a type of heat storage means, which is not able to be exposed to the maximum exhaust gas temperatures to be expected during operation. In order to avoid overheating of the heat storage means when the exhaust gas temperatures are very high, an advantageous form of the invention is possible in which the heating device is a heat exchanger, and in a heat transfer circuit including the heat exchanger a heat storage means is arranged and the heat vehicle fluid located in the heat transfer circuit is able to be selectively withdrawn from the heat transfer circuit.

In this respect the invention contemplates a particular modification in which the heat exchanger is higher up than a compensating container arranged in the heat transfer circuit for the heat vehicle fluid and a pump is arranged lower down than the neutral level in the compensating container and is arranged in the direction of flow between the compensating container and the heat exchanger.

The invention also contemplates a further design in which the heat exchanger is placed at a lower level than a compensating container arranged in the heat transfer circuit for the heat vehicle fluid, and in the direction of flow between the compensating container and the heat exchanger there is a shut off valve and between the heat exchanger and the compensating container there are, in sequence, the following: a pump, a check valve and the heat storage means.

The invention will now be described in more detail with reference to the drawing showing embodiments thereof.

LIST OF THE SEVERAL VIEWS OF THE DRAWINGS

DETAILED DESCRIPTION OF WORKING EMBODIMENTS OF THE INVENTION

The exhaust gases produced in an IC engine 10 are led off through an exhaust gas duct 12, which is connected with a heating device 14 and 50 which is continually swept by the gases and is designed in the form of a thermal converter, which will later be described herein in detail.

Figure 1:
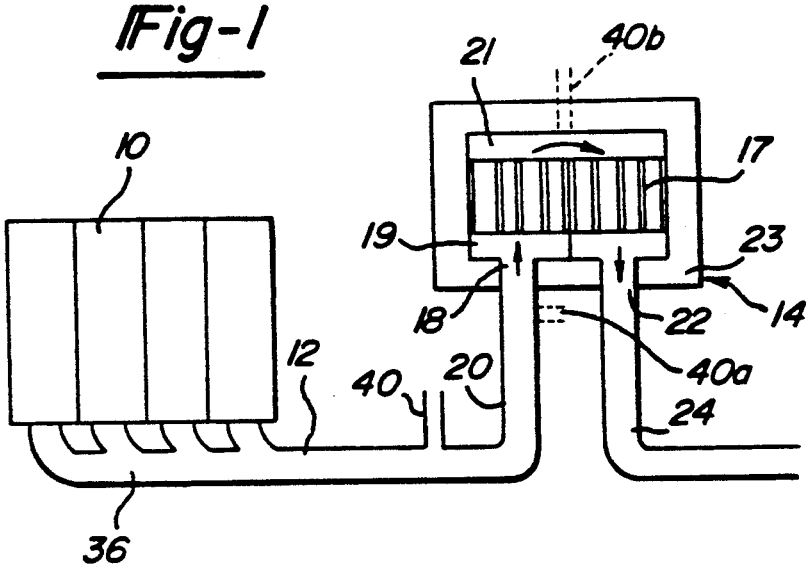
FIG. 1 is a diagrammatic representation of the exhaust gas system of an automobile IC engine with a heat storage means serving as a thermal converter.

In the case of the arrangement to be seen in FIG. 1, the heating device is in the form of a heat storage means 14, 17, whose intake 18 is connected via a section 20 of the exhaust gas duct 12 with the engine 10 and whose outlet 22 is connected by a section 24 of the exhaust gas duct 12 with the exhaust gas system.

The intake 18 is followed by a first chamber 19 for the exhaust gas to flow through. Parallel to this first chamber 19 a storage chamber 23 is arranged, which is connected with the outlet 22 and into which the exhaust gas, emerging from the first storage chamber 19, passes a chamber 21, which spans the two chambers 19 and 23 and in such chamber 21 the exhaust gas flows to the outlet 22. Air can be added at 40 and 40*a* as is known as shown by Mattavi U.S. Pat. No. 3,754,398.

This arrangement is designed on the assumption that the heat storage means 14 may be exposed to the heat exhaust gases at the maximum temperatures occurring during operation.

Figure 2:
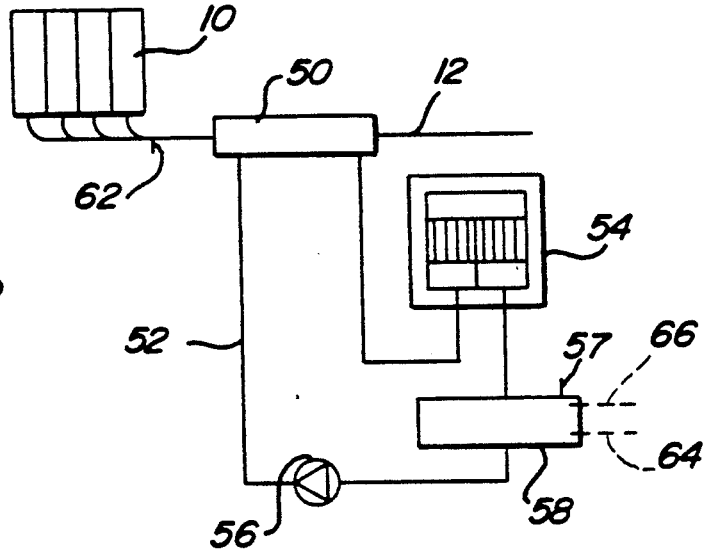
FIG. 2 is a diagrammatic representation of a first form of the exhaust gas system with a heat exchanger adapted to serve as a thermal converter.
Figure 3:
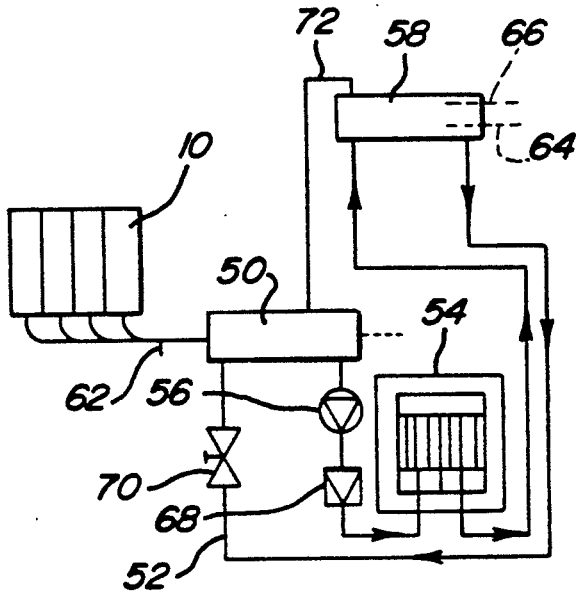
FIG. 3 shows a second possible form of this exhaust gas system.

If a heat storage means is used which is not to be exposed to gases at these temperatures or which at heavy engine loads develops an excessive pressure resistance, the thermal converter may be designed in the form of a heat exchanger 50 as shown in FIGS. 2 and 3, while the heat storage means referenced 54 therein may be heated up indirectly by the exhaust gas using a heat transfer circuit 52 including the heat exchanger 54.

In the case of the examples of the invention shown in FIG. 2 or FIG. 3, a heat exchanger 50 is placed on the exhaust gas duct 12, such heat exchanger being furthermore included in a heat transfer circuit 52. The heat transfer circuit furthermore comprises a pump 56 and a storage means 58, provided with ventilating means 57, for the heat vehicle fluid circulating in the heat transfer circuit.

In the case of operation with the liquid heat vehicle fluid in the heat transfer circuit the vertical length of the branch ducts 20 and 24 extending through the enclosure is respectively such that between the hot heat vehicle liquid in the storage means 54 and the heat vehicle liquid cooling down when the pump 56 is not in operation and which is outside the enclosure, a thermally insulating barrier layer may be formed.

In the case of the form of the invention shown in FIG. 2 the heat exchanger 50 is higher up than the compensating container 58 so that when the pump 56 is not operating the liquid heat vehicle will drain off from the heat exchanger 50 under its own weight, the level in the compensating container the rising from the operating level 64 to the resting or neutral level 66. Because the heat vehicle fluid has drained from the heat exchanger 50 it is not possible for the heat storage means 54 to be heated to temperatures which would cause it to be damaged.

As soon as the heat transfer circuit 52 is to be made operational again, the pump 56 is turned on so that the heat vehicle fluid is then pumped out of the compensating container 58 via the heat exchanger 50 to the heat storage means 54, it then either transferring stored heat in the heat exchanger 50 to the exhaust gas or transferring heat from the exhaust gas to charge the heat storage means 54.

In the case of the form of the invention shown in FIG. 3, the compensating container 58 is placed at a higher level than the heat exchanger 50 and between the heat exchanger 50 and the heat storage means 54 there are the following, arranged in the direction of pumping: the pump 56, a check valve 68 and the heat storage means 54. In the direction of pumping following the heat storage means 54 there is a shut off valve 70 between the heat storage means 54 and the heat exchanger 50.

In this form of the invention the heat exchanger 50 is emptied by the pump, which after the closing of the shut off valve pumps the heat vehicle fluid into the compensating chamber 58, whence it is prevented from flowing by the check valve 68 between the heat storage means 54 and the pump 56. After opening of the shut off valve 70 the heat vehicle fluid flows under its own weight into the heat exchanger 50. The heat exchanger 50 and the compensating container 58 and connected with each other by an air duct 72 for equalization.

I claim:

1. A method of reducing internal combustion emissions comprising:

providing an internal combustion engine;

providing exhaust means for exhausting emissions from the internal combustion engine;

providing a heating means for reducing emissions, the heating means coupled with the exhaust means;

passing exhaust gas from the internal combustion engine through the exhaust means and heating means;

charging said heating means with heat from the exhaust gases;

heating said exhaust gas at start up by said heating means when the temperature of said exhaust gas is below a desired conversion temperature;

directing said exhaust gas in a first direction into a first chamber of said heating means from said exhaust means;

passing said exhaust gas into said first chamber in said heating means;

passing said exhaust gas through the heating means to heat said exhaust gas;

exhausting said heated exhaust gas from said heating means in a direction opposite to said first direction into said exhaust means.

2. The method as claimed in claim 1, said heating means comprising a heat storage means and the conversion takes place in the heat storage means.

* * * * *